US008814285B2

(12) United States Patent
Park et al.

(10) Patent No.: US 8,814,285 B2
(45) Date of Patent: Aug. 26, 2014

(54) REFRIGERATOR

(75) Inventors: Yoo-Min Park, Jinju-si (KR); Jong-Gon Kim, Changwon-si (KR); Young-Hoon Gwak, Changwon-si (KR); Bon-Young Koo, Changwon-si (KR); Myung-Soo Kim, Gimhae-si (KR); Hyeon-Po Cho, Changwon-si (KR); Oh-Chul Kwon, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 16 days.

(21) Appl. No.: 13/532,196

(22) Filed: Jun. 25, 2012

(65) Prior Publication Data

US 2012/0262046 A1 Oct. 18, 2012

Related U.S. Application Data

(63) Continuation of application No. 12/296,823, filed as application No. PCT/KR2007/001804 on Apr. 13, 2007, now Pat. No. 8,226,182.

(30) Foreign Application Priority Data

Apr. 14, 2006 (KR) ..... 10-2006-0034219

(51) Int. Cl.
*A47B 96/04* (2006.01)
*F25D 25/02* (2006.01)

(52) U.S. Cl.
CPC ..... *F25D 25/025* (2013.01); *A47B 2210/17* (2013.01)
USPC ..... 312/402

(58) Field of Classification Search
CPC ..... F25D 25/025
USPC ..... 312/330.1, 334.1, 334.7, 312/334.44–334.47, 404
See application file for complete search history.

(56) References Cited

U.S. PATENT DOCUMENTS

| | | | | |
|---|---|---|---|---|
| 843,194 | A | 2/1907 | Coolbaugh | |
| 1,716,242 | A | 6/1929 | Ritsche | |
| 1,861,123 | A | 5/1932 | Kuckel | |
| 1,975,327 | A | 10/1934 | Loney | |
| 2,254,832 | A | 9/1941 | Weight | |
| 2,573,272 | A | 10/1951 | Petkwitz | |
| 2,755,158 | A | 7/1956 | Davidson | |
| 3,106,072 | A | 10/1963 | Muffly | |
| 3,722,975 | A * | 3/1973 | Taylor | 312/334.44 |
| 3,846,001 | A * | 11/1974 | Kaplan et al. | 384/23 |
| 5,820,239 | A | 10/1998 | Christenson et al. | |
| 6,193,340 | B1 * | 2/2001 | Schenker et al. | 312/265.5 |
| 6,250,730 | B1 | 6/2001 | Roth et al. | |
| 8,226,182 | B2 * | 7/2012 | Park et al. | 312/404 |
| 2005/0162054 | A1 | 7/2005 | Jackson | |
| 2008/0202146 | A1 * | 8/2008 | Lim et al. | 62/382 |

FOREIGN PATENT DOCUMENTS

| | | | |
|---|---|---|---|
| CN | 1079531 | C | 2/2002 |
| KR | 20-0109836 | Y1 | 9/1995 |
| KR | 1995-0025571 | A | 9/1995 |
| KR | 10-1998-0008047 | | 3/1998 |
| KR | 10-0206914 | B1 | 7/1999 |
| KR | 10-1999-0074444 | B1 | 10/1999 |
| KR | 1999-0074444 | B1 | 10/1999 |
| KR | 20-0406024 | Y1 | 1/2006 |
| WO | WO 2005/083339 | A1 | 9/2005 |

* cited by examiner

*Primary Examiner* — Darnell Jayne
*Assistant Examiner* — Timothy M Ayres
(74) *Attorney, Agent, or Firm* — Birch, Stewart, Kolasch & Birch, LLP

(57) ABSTRACT

A refrigerator capable of preventing the drooping of a bin when the bin is pulled out of the storage space is provided. The refrigerator does not need to fit a guide device when users push the bin into the storage space, since the bin is completely separated from the guide device.

18 Claims, 3 Drawing Sheets

REFRIGERATOR

CROSS REFERENCE TO RELATED APPLICATIONS

This application is a Continuation of co-pending application Ser. No. 12/296,823 filed on Oct. 10, 2008, which is a National Phase of PCT International Application No. PCT/KR2007/001804 filed on Apr. 13, 2007, which claims priority to Application No. 10-2006-0034219 filed in the Republic of Korea on Apr. 14, 2006. The entire contents of all of the above applications are hereby incorporated by reference.

TECHNICAL FIELD

The present invention relates to a refrigerator that the bin is easily pulled out from the storage space.

BACKGROUND ART

In general, a refrigerator is an appliance storing foods under low temperature. A refrigerator maintains the storage space under low temperature by refrigerant cycle.

A bin is arranged in the storage space of a refrigerator arranged in the storage space as capable of being pulled out. It is possible for the bin to keep vegetables, fruits and other various foods. Users pull the bin out of the refrigerator and push the bin into the storage space after taking out foods stored in the bin. Here, the bin is easily pulled out by a guiding equipment.

However, when the bin is completely pulled out, the bin droops due to the weight of the bin itself and the weight of the foods in the bin. Therefore, it was inconvenient for users to push the drooped bin into the storage space.

Further, the bin breaks away from the guide device when the bin droops down. In this case, users had to push the bin after setting the bin on the guide device.

Furthermore, it was inconvenient for users to take foods out of the bin when the bin was not pulled out sufficiently,

DISCLOSURE OF INVENTION

Technical Problem

An object of the present invention is to provide a refrigerator capable of preventing the drooping of bin even when the bin is pulled out.

Another object of the present invention is to provide a refrigerator that the bin is easily pushed in.

Another object of the present invention is to provide a refrigerator preventing the breaking away of bin from guide device, even when the bin is completely pulled out.

Technical Solution

According to an aspect of the present invention to achieve the above-mentioned objects, there is provided a refrigerator comprising a body having a storage space; a bin arranged as capable of pulled out from the storage space; a guide device arranged in the storage space and guiding the draw of the bin; and a stopper supporting the rear of the bin to prevent inclination of the bin in a side when the bin is pulled out.

According to another aspect of the present invention, there is provided a refrigerator comprising a body having storage space; a bin arranged in the storage space to be pulled out; a guide device arranged in the storage space and guiding the draw of the bin; a stopper supporting the rear of the bin to prevent inclination of the bin when the bin is pulled out; and a roller supporting the guide device and arranged at the front before the stopper.

According to another aspect of the present invention, there is provided a refrigerator comprising a body having storage space; a bin arranged in the storage space to be pulled out; a stopper supporting the rear of the bin to prevent inclination of the bin when the bin is pulled out; a guide rail arranged at the storage space; a roller arranged at the storage space; and a guide rib arranged at the bin, coupled with the guide rail as capable of moving, and having a restriction portion engaged with the roller at the state that the bin is pulled out.

According to another aspect of the present invention, there is provided a refrigerator comprising a body having storage space; a bin arranged in the storage space to be pulled out; a guide rail arranged at the storage space; a guide rib arranged at the bin and engaged with the guide rail as capable of moving; a roller arranged at the storage space; a stopper preventing the inclination of the top of the bin forwardly at the state that the bin is pulled out; and a restriction portion formed at the guide rib and preventing the sink of the rear of the bin downwardly to prevent the drooping down of the bin when the bin is pulled out.

In the above-mentioned preferred embodiments, it is possible for the guide rail to be inclined in the upward against the direction that the bin is pulled out.

It is possible for the stopper to be arranged at the front before the stopper.

It is possible for the stopper to be arranged at the upper part of the bin.

It is possible for the stopper to have an protrusion restricting the top of the bin when the bin is pulled out.

It is possible for the restriction portion to be protruded at the lower part of the guide rib.

Advantageous Effects

According to the present invention, it is effective in that the drooping of the bin is prevented even when the bin is pulled out.

Further, according to the present invention, it is effective in that the bin is easily pushed in, since it is not drooping.

Furthermore, according to the present invention, it is effective in that the breaking away of the bin from the guide device is prevented even when the bin is completely pulled out.

BEST MODE FOR CARRYING OUT THE INVENTION

Reference will now be made in detail as for the present invention with reference to the accompanying drawings. The idea of the present invention is, however, not limited to the above-mentioned preferred embodiment, and new preferred embodiments included in the scope of the idea of the related or present invention can be proposed as adding other compositions, changing and deleting compositions.

Figure 1:
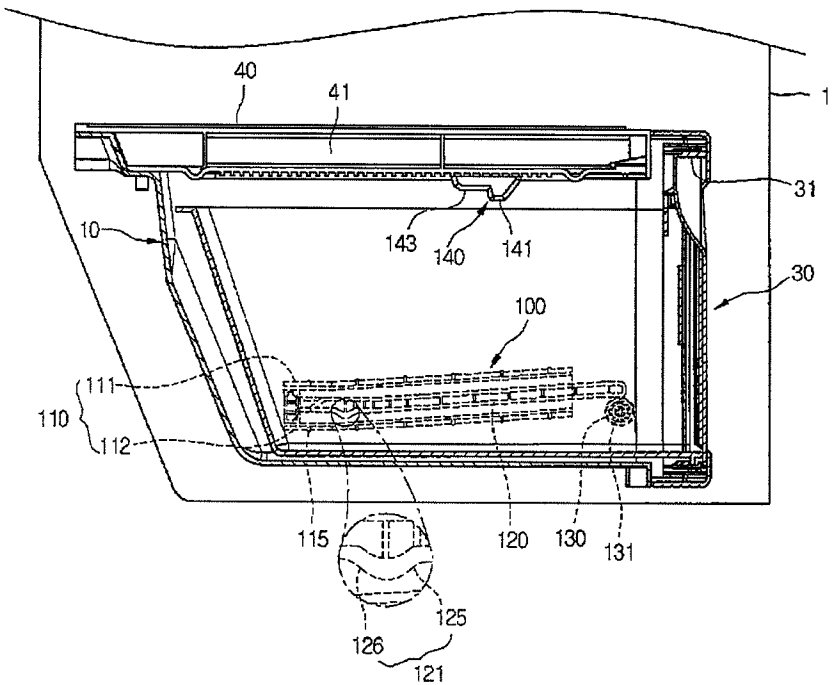
FIG. 1 is a cross-sectional view illustrating a refrigerator according to the present invention.

Referring to FIG. 1, a casing 10 is arranged in the body 1 of the refrigerator. The casing 10 forms a sort of storage space 20 in substance. The casing 10 contains a bin 30 that can be pulled out and pushed in a grip 31 that users can grip and pull is formed on the front of the bin 30. The bin 30 is formed in shape of a box that the top is opened. It is possible for this kind of shape of the bin 30 to be changed in various ways in accordance with the shape of the storage space formed by casing 10.

A cover 40 is arranged on the top of the bin 30. The cover 40 is arranged to cover the opened top of the bin 30. A path 41 is formed in the cover 40. Cool air flows through the path 41 to cool the foods stored in the bin 30.

guide devices 100 are arranged in the storage space 20. Here, it is possible for the guide devices 100 to be arranged at the both sides of the storage space 20. It is possible for the guide device 100 to include guide a rail 110 and a guide rib 120.

The guide rail 110 is arranged at the both sides of the storage space 20. The guide rail is arranged as drawing long along the pulling direction of the bin 30. Here, it is possible for the guide rail 100 to be formed in a single structure with the storage space 20, or to be coupled with the both sides of the storage space 20 by separate coupling members.

It is possible for the guide rail 100 to be composed of an upper guide rail 111 and a lower guide rail 112. Here, it is possible for the upper and lower guide rails to be arranged as adjacent to each other in the up and down positions with a predetermined interval. Further, it is possible that a reinforcing reeve 120 are formed the upper and lower guide rails 112 to reinforce the strength.

A moving guide rib 120 is coupled with the guide rail 110. The guide rib 120 is formed at the external of the bin 30. It is possible for the guide rib 120 to be formed as drawing long along the pulling direction of the bin 30.

It is possible for the guide rib 120 to be formed as unified with the bin 30 or to be coupled at the external of the bin by separate coupling members. Here, the guide rib 120 is arranged only at a side of the bin 30 when the guide rail 110 is arranged only at a side of the storage space 20. Further, the guide rib 120 is arranged at both sides of the bin 30 when the guide rail 110 is arranged at both sides of the storage space 20. Furthermore, though it is not illustrated, it is possible that a separate roller 130 is arranged at each of the upper and lower guide rail 112. The guide rib 120 includes a first rib, a second rib spaced apart from the first rib, and at least one third rib that connects the first rib and the second rib. The at least one third rib includes a fourth rib and a fifth rib longer than the fourth rib.

It is possible for the guide device 100 to be arranged as inclined against the pulling direction of the bin 30. For instance, it is possible for the guide rail 110 and the guide rib 120 to be arranged as being inclined as the front of the body 1 is relatively higher than the rear of the body 1. Therefore, it is possible to minimize the drooping of the bin when the bin 30 is pulled out of the storage space 20. Furthermore, it is convenient to push the bin 30 into the storage space 20, since the bin 30 is not drooping down.

It is possible that a roller 130 is arranged at the both sides of the storage space 20. Here, it is possible for the roller 130 to be arranged at the front of the guide rail 110 to support the bottom of the guide rib 120 when the bin 30 is pulled out. The roller is installed to be rotated with the rotating shaft 131 as centering. It is possible for the rotating shaft 131 to be arranged at the position almost same to the front end of the lower guide rail 112.

A stopper 140 is arranged at the storage space 20 to support the rear of the bin 30 at the state that the bin is pulled out. For instance, it is possible for the stopper 140 to be arranged to support the rear top of the bin 30 at the state that the bin is pulled out. Further, it is also possible for the stopper 140 to be arranged to support both rear sides of the bin 30 at the state that the bin 30 is pulled out. The stopper 140 as above prevents the drooping down of the bin 30 at the state that the bin 30 is pulled out.

It is possible that an protrusion 141 is formed at the front of the stopper 140. The protrusion 141 restricts the top of the bin 30 when the bin 30 pulled out of the storage space 20 is about to be drooping down. Therefore, the protrusion 141 prevents the drooping of the bin 30 even when the bin 30 is pulled out, and also prevents the separation of the guide rib 120 from the guide rail 110.

An inclined part 142 is formed at the front of the protrusion 141. The inclined part 142 let the bin 30 be smoothly moved when pushing the bin 30 into the storage space 20 after washing the bin.

Further, a supporting unit 143 is formed at the rear of the stopper 140. The supporting unit 143 supports the rear top of the bin 30 at the state that the bin 30 is pulled out.

Furthermore, it is possible for the roller 130 to be arranged before the stopper at the front. Here, the stopper 140 restricts the top of the bin 30 after the rotating shaft of the bin at the rear, when the bin 30 is about to be rotated with the roller 130 as the rotating center at the state that the bin 30 is pulled out. Therefore, it is prevented that the bin is drooping down as rotated.

Further, it is possible that a restriction portion 121 is formed at the guide rail 110 to prevent the bottom of the bin 30 going backward at the state that the bin 30 is pulled out. It is possible for the restriction portion 121 to be protruded at the lower side of the guide rail 110. Therefore, the restriction portion 121 is arranged at the front of the roller 130 when the bin is completely pulled out. It is possible for the restriction portion 121 to be rounded so as to cross along the roller 130 when the bin 30 is pulled out. A first guide unit 125 is formed at the front end of the restriction portion 121. The first guide unit 125 leads the roller 130 to cross along the restriction portion 121 when the bin 30 is pulled out of the storage space 20.

Further, a second guide unit 126 is formed at the rear of the restriction portion 121. The second guide unit 126 leads the roller 130 to cross along the restriction portion 121 when the bin 30 is pushed into the storage space 20. Furthermore, the roller 130 prevents that the second guiding unit 126 is pushed back, since the roller 130 is engaged with the second guiding unit 126 when the bin 30 is pulled out of the storage space 20. Therefore, the bin stays as inclined upwardly.

It is advisable for the first and the second guide units 126 to be formed as symmetrized against each other. Therefore, it is minimized that the roller is interfered by restriction portion 121 at the process that the bin 30 is pulled out.

It is possible for the bottom of the bin 30 to be adjacent to the bottom of the storage space 20 at the state that the bin 30 is arranged in the inside of the storage space 20.

Reference will now be made in detail as for the operation of the preferred embodiment of a refrigerator according to the present invention.

Figure 3:
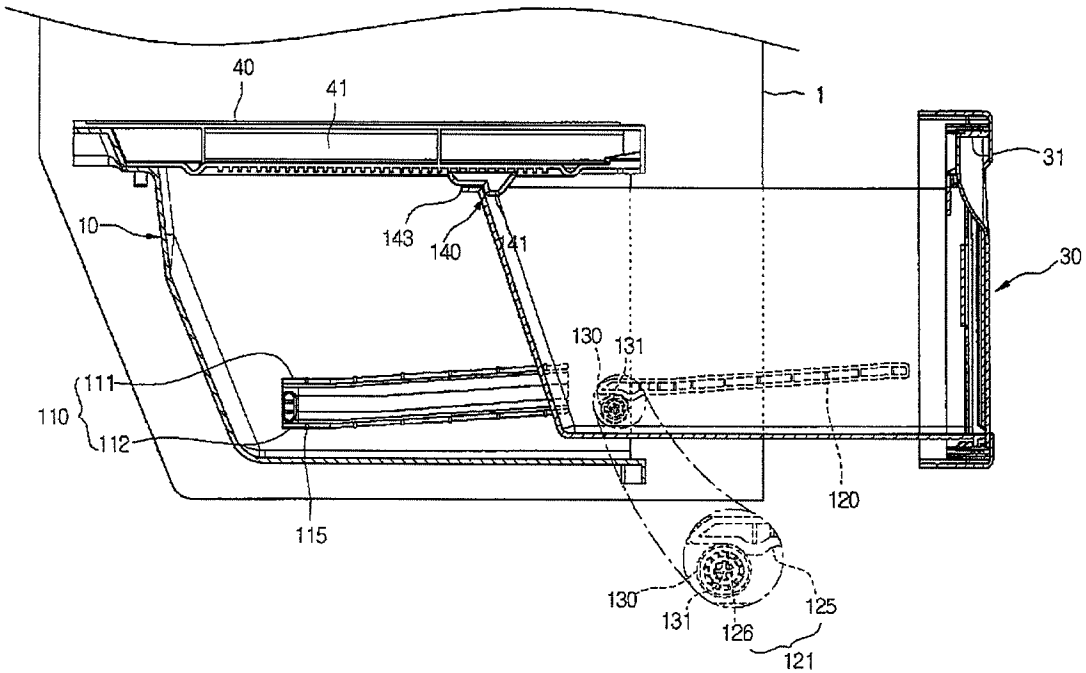
FIG. 3 is a cross-sectional view illustrating the state that the bin is completely pulled out of the refrigerator in FIG. 1.

The process that the bin 30 is pulled out is illustrated in FIGS. 3 and 4.

Figure 2:
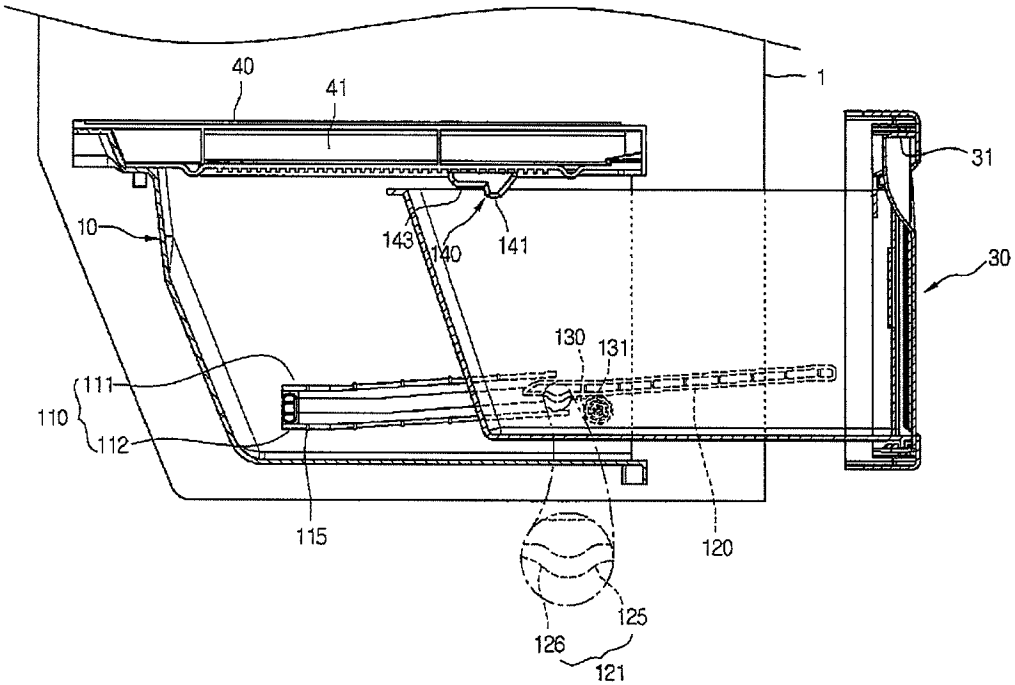
FIG. 2 is a cross-sectional view illustrating the state that the bin is pulled out of the refrigerator in FIG. 1.

Referring to FIG. 2, the bin 30 is pulled out toward the front of the storage space 20 when a user pulls the grip of the bin 30. The guide rib 120 moves along the guide rail 110 as sliding with the bin 30. The roller 130 supporting the guide rib 120 is rotated as the guide rib 120 is moved. Here, the bin 30 is pulled out as a little inclined upwardly, since the guide rail 110 and the guide rib 120 are arranged to be inclined upwardly.

Referring to FIG. 3, the guide rib 120 completely separated from the guide rail 110 when the bin 30 keeps pulled out of the storage space 20. Here, the roller 130 is rotated along the first guide unit 125 of the restriction portion 121. The restriction portion 121 is engaged with the roller 130 when the bin 30 is pulled out till the roller contacts the second guide unit 126 of the restriction portion 121. At the same time, the rear top of the bin 30 is engaged with the protrusion 141 of the stopper 140. Here, a rotating torque with the roller as rotating center by the weight of bin and the weight of foods contained is engaged with the bin 30. However, the bin 30 is not rotated with the roller as centering, but is maintained as inclined upwardly, since the restriction portion 121 arranged at the lower side of the bin 30 is at the state engaged with roller 130 and the rear top of the bin 30 is engaged with the protrusion 141 of the stopper 140. Therefore, it is prevented that the bin 30 is drooping down when it is pulled out of the storage space 20. Further, the inconvenience suiting the guide rib 120 on the guide rail 110 when users push the bin 30 back into the storage space 20 is overcome, since it is prevented that the bin 30 is completely pulled out and separated from the guide device 100.

INDUSTRIAL APPLICABILITY

The industrial applicability of the refrigerator according to the present invention configured as above is very high as the bin of the refrigerator is effectively pulled out.

What is claimed is:

1. A refrigerator comprising:

a body having a storage space;

a case provided in the storage space;

a cover that covers an upper part of the case, the cover comprising a cooling path, and the cover being connected to the case;

a bin arranged in a space defined by the case and the cover, the bin configured to be pulled out;

a guide rail arranged at an inner side wall of the case, the guide rail being disposed under a first line that bisects a height of the inner side wall of the case;

a guide rib arranged at a side surface of the bin, the guide rib extending a predetermined length to be accommodated within the guide rail such that the guide rib is movable along the guide rail, the guide rib being configured to be longer that the guide rail, the guide rib being integrally formed with the bin and being disposed under a second line that bisects a height of the side surface of the bin; and a roller arranged at the case to support the guide rib when the bin is pulled out, wherein the guide rib comprises a first rib, a second rib spaced apart from the first rib and provided under the first rib, and a plurality of third ribs that connect the first rib and the second rib, wherein each rib of the plurality of third ribs extends in an up and down direction, wherein each rib of the plurality of third ribs is spaced apart from each other, wherein a plurality of recesses is formed between the first and second ribs, each recess of the plurality of recesses being defined by adjacent pairs of third ribs, and wherein the second rib is provided with a restriction portion protruded therefrom.

2. The refrigerator according to claim 1, wherein the restriction portion is downwardly protruded from the second rib.

3. The refrigerator according to claim 1, wherein one rib of the plurality of third ribs is formed longer than another rib of the plurality of third ribs.

4. The refrigerator according to claim 1, wherein at least a portion of the second rib is rounded.

5. The refrigerator according to claim 1, wherein the restriction portion is formed as a rounded shape to allow the restriction portion to cross over the roller when the bin is pulled out.

6. The refrigerator according to claim 1, wherein the guide rail is formed at a lower side portion of the case and the guide rib is formed at a lower side portion of the bin.

7. The refrigerator according to claim 1, further comprising a stopper arranged at a lower surface of the cover to prevent a top of the bin from being completely separated from the case.

8. The refrigerator according to claim 7, wherein the stopper comprises:

a protrusion formed at a front of the stopper to restrict the top of the bin when the bin is pulled out of the storage space;

an inclined part formed at a front of the protrusion to allow the bin to be smoothly moved when the bin is pushed into the storage space; and a supporting unit formed at the rear of the stopper to support the rear top of the bin when the bin is pulled out.

9. The refrigerator according to claim 7, wherein the stopper protrudes into an interior of the bin.

10. The refrigerator according to claim 7, wherein the stopper contacts the bin and the roller contacts the restriction portion in order to prevent the drooping of the bin when the bin is completely pulled out.

11. The refrigerator according to claim 1, wherein a path is formed in the cover to supply a cool air to the bin through the path.

12. The refrigerator according to claim 1, wherein the bin comprises a front member having a handle and a box defining a space for storing food, and wherein the front member covers the storing space of the case and the cover.

13. The refrigerator according to claim 1, wherein each rib of the plurality of third ribs are spaced apart from each other in a direction parallel to an extending direction of the first guide rib.

14. The refrigerator according to claim 1, wherein the guide rail comprises a first rail and a second rail spaced apart from the first rail and disposed under the first rail to define a space to receive the guide rib, and wherein the roller supports the guide rib in a state where the guide rib is entirely taken out of the space.

15. The refrigerator according to claim 1, wherein the first, second and third ribs are integrally formed with the side surface of the bin.

16. The refrigerator according to claim 1, wherein the first rib, the second rib and the guide rail are arranged as inclined against a pulling direction of the bin.

17. The refrigerator according to claim 1, wherein a distance between adjacent third ribs is less than a length of each of the first and second ribs.

18. The refrigerator according to claim 1, wherein at least a portion of the guide rib is under a third line that bisects a height between the second line and a lower edge of the side surface of the bin.

* * * * *